United States Patent [19]

Schulz et al.

[11] Patent Number: 4,735,020

[45] Date of Patent: Apr. 5, 1988

[54] PORTABLE ELECTRIC GRINDER

[75] Inventors: Manfred Schulz, Nürtingen; Gerhard Waldner, Neckarhausen; Alfred Wagemann, Nürtingen, all of Fed. Rep. of Germany

[73] Assignee: Metabowerke GmbH & Co., Nürtingen, Fed. Rep. of Germany

[21] Appl. No.: 21,971

[22] Filed: Mar. 5, 1987

[30] Foreign Application Priority Data

Mar. 6, 1986 [DE] Fed. Rep. of Germany ..... 3607377

[51] Int. Cl.[4] ..... B24B 23/00; G05G 5/06

[52] U.S. Cl. ..... 51/170 R; 173/164; 74/527

[58] Field of Search ..... 51/170 R, 170 PT, 170 T; 74/527; 173/164

[56] References Cited

FOREIGN PATENT DOCUMENTS

| | | | |
|---|---|---|---|
| 152564 | 8/1985 | European Pat. Off. | 51/170 T |
| 2948080 | 6/1981 | Fed. Rep. of Germany . | |
| 3120871 | 12/1982 | Fed. Rep. of Germany | 51/170 T |
| 3328955 | 2/1985 | Fed. Rep. of Germany . | |
| 3405885 | 1/1986 | Fed. Rep. of Germany . | |

OTHER PUBLICATIONS

German Utility Model No. G83 17 913, 11/1984, Bosch.

*Primary Examiner*—Roscoe V. Parker

*Attorney, Agent, or Firm*—Peter K. Kontler

[57] ABSTRACT

A portable electric grinder wherein the grinding wheel is held against rotation relative to the spindle by two annular clamping rings. The spindle has a motor-driven hollow outer shaft and an inner shaft which is installed in the outer shaft and can be held against rotation with the outer shaft by a manually depressible arresting member. One of the clamping rings rotates with the hollow shaft and the other clamping ring mates with the inner shaft. When the inner shaft is held against rotation and the motor is started for a short interval of time, the hollow shaft rotates the one clamping ring which rotates the grinding wheel and the other clamping ring by friction so that the grip of the clamping rings upon the grinding wheel is loosened and the grinding wheel can be fully separated from the spindle by completing the unscrewing of the other clamping ring from the inner shaft. The motor drives the hollow shaft through the medium of a step-down transmission.

14 Claims, 2 Drawing Sheets

PORTABLE ELECTRIC GRINDER

BACKGROUND OF THE INVENTION

The invention relates to portable power tools in general, and more particularly to improvements in power tools of the type wherein a rotary grinding wheel, sander or a like material removing tool is releasably clamped to a motor-driven spindle.

It is known to grip the rotary tool (hereinafter called grinding wheel) between two clamping portions so that the grinding wheel is compelled to rotate with a spindle which is normally driven by a prime mover (such as an electric motor) through the medium of a step-down transmission. One of the clamping portions has internal threads which mate with the external threads of the spindle. It is further known to assemble the spindle from two shafts one of which is hollow and surrounds the other shaft. Reference may be had to German Pat. No. 34 05 885 which further proposes that the two shafts of the composite spindle be rotated as a unit when the two clamping portions bear against and clamp the grinding wheel between them.

Problems arise when the user of the just described power tool attempts to separate the grinding wheel from the spindle. As a rule, the grip of the clamping portions upon the grinding wheel is tightened when the power tool is in use, i.e., the, internally threaded clamping portion is compelled to move toward the other clamping portion and to thus bear against the grinding wheel with a force which cannot be readily overcome by the operator, even if the operator uses a wrench or a like tool.

Attempts to overcome the just discussed problems include the mounting of one of the clamping portions on the hollow (motor-driven) shaft against rotation with reference thereto so that the clamping action upon the grinding wheel increases only if the grinding wheel is caused to turn (i.e., slip) relative to the one clamping portion together with the other clamping portion which mates with the respective shaft. In fact, such mounting of the clamping portions on the composite spindle of a portable power tool is now prescribed by authorities in certain countries including the German Federal Republic. It has been found that, in spite of such safety precautions, after a certain interval of use of the power tool the clamping action upon the grinding wheel is still so pronounced that the removal of the grinding wheel is a cumbersome, strenuous and time-consuming operation.

German Pat. No. 34 05 885 discloses a mode of detaching the grinding wheel from the spindle of a portable power tool practically without the need for any hand tools. The inner shaft of the spindle is stressed by a spring and can be shifted by a thread so as to reduce the clamping force. However, when the patented portable power tool is in actual use, the clamping portions turn relative to each other by friction so that the spring which biases the inner shaft is fully compressed and acts not unlike a rigid body. Once the spring is fully compressed, the grinding wheel can be released only in response to the application of a very large force.

German Utility Model No. 83 17 913 discloses means for arresting the spindle for the purpose of removing the grinding wheel. The user must resort to tools which relax the clamping action upon the grinding wheel while the spindle is held against rotation. The outer clamping disc has holes to allow for penetration of studs on the tool which is used to relax the clamping action.

German Offenlegungsschrift No. 29 48 080 discloses an angular portable grinding tool with means for automatically clamping and releasing the grinding wheel. Such automatic means comprises rod-like motion transmitting elements which extend the full length of the power tool and contribute to the bulk, cost and complexity of the power tool. Moreover, the automatic clamping and releasing means comprises a large number of parts which contributes to initial, maintenance and assembly cost.

Applicants are further aware of the right-angle grinder which is disclosed in German Offenlegungsschrift No. 33 28 955 and is equipped with a safety clutch. The spindle of this power tool also comprises an inner shaft and a hollow outer shaft but the power tool does not embody any specially designed means for facilitating rapid and convenient detachment of the grinding wheel.

OBJECTS AND SUMMARY OF THE INVENTION

An object of the invention is to provide a portable power tool wherein the material removing tool can be readily detached from the spindle in a time-saving operation and without the exertion of any manually applied force or with the exertion of a negligible manually applied force.

Another object of the invention is to provide a portable power tool, especially a grinder or sander, wherein the material removing tool can be removed or loosened automatically whenever the operator desires.

A further object of the invention is to provide novel and improved means for controlling the rotation of one part of a composite spindle in a portable power tool of the above outlined character.

An additional object of the invention is to provide a power tool wherein the detachment or loosening of the material removing tool takes up a short interval of time.

Still another object of the invention is to provide a power tool wherein the material removing tool can be clamped or released in a novel and improved way.

A further object of the invention is to provide a novel and improved method of manipulating a portable power tool for the purpose of relaxing the clamping action upon the material removing tool.

Another object of the invention is to provide a portable power tool wherein the material removing tool can be released with equal facility after short or long periods of continuous or interrupted use.

The invention resides in the provision of a portable power tool, particularly an electric grinder or sander. The power tool comprises a composite rotary tool supporting spindle including a hollow shaft and an inner shaft in the hollow shaft, drive means for rotating one of the shafts (e.g., the hollow shaft), tool clamping means including first and second clamping portions which are respectively mounted on the inner and hollow shafts and are movable apart, to thereby release a tool which is normally clamped between them, in response to rotation of the shafts relative to each other, and means for arresting the other shaft so as to effect a movement of the clamping portions away from each other and to thus effect a release of the tool between the clamping portions by rotating the one shaft through the medium of the drive means while the arresting means holds the other shaft against rotation.

The arresting means preferably comprises an arresting member (e.g., a reciprocable pin or stud) which is movable by hand to a position of engagement with the other shaft, and means (e.g., a coil spring) for yieldably biasing the arresting member away from the position of engagement with the other shaft, i.e., the arresting member is automatically disengaged from the other shaft when the operator ceases to forcibly maintain the arresting member in its operative position. The other shaft is preferably provided with at least one recess for reception of a portion of the arresting member when the latter is maintained in the position of engagement with the other shaft. The arrangement is preferably such that the two shafts have certain limited freedom of axial movement relative to each other, at least when the clamping portions do not engage and hold a disc, a wheel or another rotary material removing tool.

The other shaft can comprise a main portion and an annular portion which is separably affixed to the main portion and has a plurality of recesses which are angularly offset relative to each other in the circumferential direction of the annular portion. Each recess can receive the aforementioned portion of the arresting member so that a small angular displacement of the other shaft relative to the arresting member suffices to move a recess into register with the arresting member. For example, the main portion of the other shaft can be provided with an externally splined section and the annular portion of such shaft has internal splines mating with the splines of the main portion to hold the annular portion against rotation relative to the main portion. A nut can be provided to mate with the other shaft in order to hold the annular portion in a fixed axial position relative to the main portion of the other shaft.

An end portion of the inner shaft which is remote from the clamping means is preferably mounted in an antifriction bearing which is installed in the housing of the power tool, and a portion of the hollow shaft which is remote from the clamping means is preferably mounted in a second antifriction bearing which is also installed in the housing. The two bearings are preferably spaced apart from each other in the axial direction of the spindle, and the drive means for the one shaft can comprise a gear (e.g., a bevel gear) which is non-rotatably secured to the one shaft between the two bearings. A second portion of the inner shaft is adjacent its end portion, and the first bearing and mates with the aforementioned nut for the annular portion of the inner shaft. The splined section is preferably adjacent the second portion of the inner shaft.

In accordance with a presently preferred embodiment, one portion of the clamping means is rigid or integral with the hollow shaft and the other portion of the clamping means has internal threads mating with external threads which are provided therefor on the inner shaft.

The housing can be provided with a tubular socket and the arresting means can constitute a prefabricated unit or module which is removably installed in the socket, preferably in such a way that the arresting member is movable substantially radially of the aforementioned annular portion. The arresting member can be provided with an abutment (e.g., an annular collar) and the biasing means can comprise one or more springs which react against the socket and bear against the abutment to oppose the movement of the arresting member substantially radially of and toward the other shaft. The socket can be provided with means (e.g., a washer and/or a split ring) for limiting the extent of movability of the arresting member under the action of the biasing means.

As mentioned above, the drive means can comprise an electric motor and the power tool preferably further comprises motor operating means which is actuatable by the operator to start the motor for a selected interval of time for the purpose of rotating the one shaft relative to the other shaft while the other shaft is held against rotation by the arresting means so as to release the tool between the portions of the clamping means. The operating means can comprise an electric switch which is preferably designed to transmit to the motor a short-lasting current impulse irrespective of the duration of actuation of the switch. The power tool can further comprise means for limiting the amount of electrical energy which can be supplied to the motor in response to actuation of the switch so as to reduce the likelihood of generation of a pronounced moment of reaction when the motor is started solely for the purpose of releasing the tool which is normally clamped between the two portions of the clamping means.

The novel features which are considered as characteristic of the invention are set forth in particular in the appended claims. The improved power tool itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
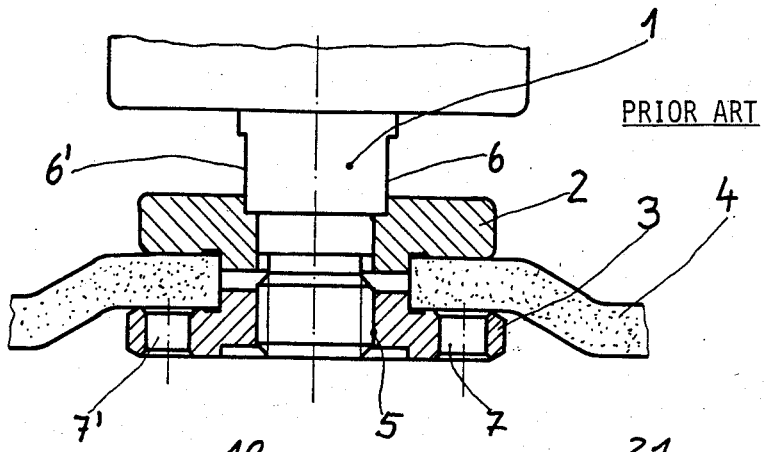
FIG. 1 is a fragmentary partly elevational and partly sectional view of a conventional portable power tool.

Referring first to FIG. 1, there is shown a portion of a conventional portable power tool wherein a one-piece motor-driven rotary spindle 1 has several flats 6, 6′ for one annular portion 2 of the means for clamping a disc-shaped or similar grinding or sanding tool 4 to the spindle. The clamping means further comprises a second annular portion 3 which has internal threads mating with external threads 5 at the free end of the spindle 1. The clamping portion 3 has a set of axially parallel holes (two shown at 7 and 7′) for the studs of a suitable tool (e.g., a first wrench, not shown) which must be applied in order to rotate the clamping portion 3 in a direction to move it away from the clamping portion 2 and to thus allow for removal of the tool 4. A second tool (e.g., a second wrench) must be used to engage the flats 6, 6′ while the clamping portion 3 is rotated by the first tool in order to ensure that the clamping portions 2 and 3 will not rotate as a unit.

A drawback of the just described conventional power tool is that the rotary grinding tool 4 tends to slip relative to the clamping portion 2 and to thereby rotate the clamping portion 3, especially when the tool 4 abruptly encounters a pronounced resistance to rotation with the spindle 1. This results in an axial movement of the clamping portion 3 toward the clamping portion 2 so that the tool 4 is clamped with a substantial force which cannot be readily overcome when the person in charge desires to replace the tool 4.

Figure 2:
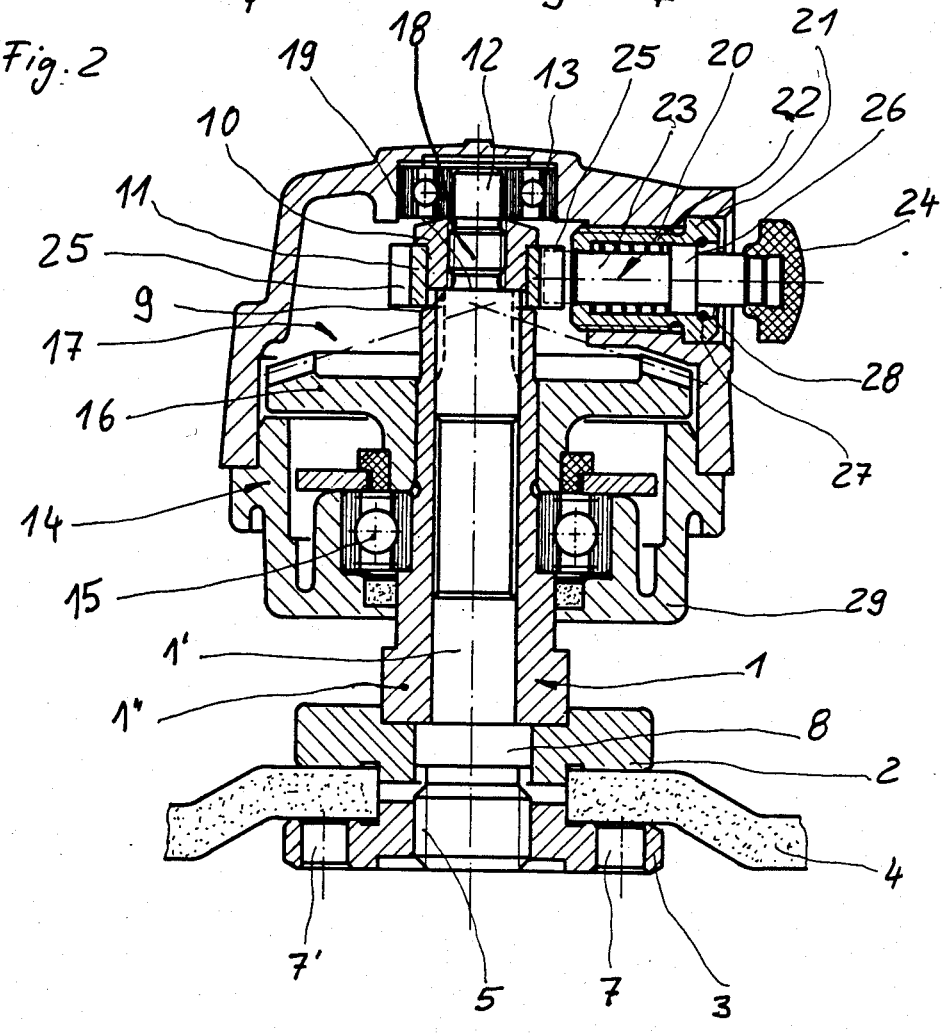
FIG. 2 is a fragmentary sectional view of a power tool which embodies one form of the present invention.

FIG. 2 shows a portion of a portable power tool 30 (FIG. 3) which embodies one form of the present 35 invention. The spindle 1 comprises an inner shaft 1' and a hollow outer shaft 1" which is coaxial with and surrounds a substantial part of the inner shaft. The latter has a collar 8 which is adjacent the free end of the spindle 1 and is surrounded by a first annular clamping portion 2 of the means for clamping the grinding wheel 4 in such a way that the grinding wheel is compelled to share the angular movements of the spindle 1. The clamping means further comprises an internally threaded second annular clamping portion 3 which mates with the externally threaded free end portion 5 of the inner shaft 1'. When the clamping portion 3 (which is actually a nut having axially parallel holes 7, 7' for the studs of a suitable tool) is tightened, it causes the grinding wheel 4 to bear against the clamping portion 2 which is urged against the front end face of and cannot rotate relative to the hollow outer shaft 1". The shaft 1" extends between the collar 8 of the shaft 1' and a sleeve 11 which can be said to constitute a separable annular portion of the inner shaft 1'. The shaft 1" is preferably mounted with relatively small freedom of axial movement relative to the shaft 1'. The main portion of the shaft 1' has external splines 9 which mate with internal splines of the sleeve 11 so that the latter cannot rotate with reference to the main portion. A nut 10 is provided to mate with an externally threaded section 18 of the main portion of the shaft 1' in order to hold the sleeve 11 against axial movement. The nut 10 is adjacent an inner end portion 12 or stub of the shaft 1', and such end portion is mounted in an antifriction bearing 13 installed in the housing 14 of the power tool 30. A second antifriction bearing 15 is installed in the housing 14 for the hollow shaft 1"; the bearings 13 and 15 are spaced apart from each other in the axial direction of the spindle 1 and provide room between them for a bevel gear 16 which constitutes one element of the drive means for rotating the hollow shaft 1". The bearing 15 is actually installed in a detachable cover or lid 29 of the housing 14.

The shafts 1' and 1" rotate as a unit when the outer clamping portion 3 is tightened so that it urges the hub of the grinding wheel 4 against the clamping portion 2 which, in turn, bears against the front end face of and rotates with the driven shaft 1". The gear 16 forms part of a step-down transmission 17 which operates between the prime mover 35 of the power tool 30 and the hollow shaft 1". This gear receives torque from the prime mover 35 by way of a pinion, not shown. The reference character 19 denotes an annular shoulder on the main portion of the shaft 1' for the nut 10.

In accordance with a feature of the invention, the power tool 30 further comprises a modular arresting unit 20 which is separably installed in a tubular socket 21 of the housing 14 and includes a reciprocable stud-shaped arresting member 23 movable into and from engagement with the annular portion or sleeve 11 of the shaft 1' so that the latter can be held against rotation with the hollow outer shaft 1". The arresting unit 20 further comprises a coil spring 22 which reacts against the bottom wall of the socket 21 and bears against a collar 26 of the arresting member 23 to bias the latter axially and away from the shaft 1'. The extent to which the arresting member 23 can be moved away from the shaft 1' under the action of the coil spring 22 is determined by a washer 27 which serves as an abutment for the collar 26 and is held in the socket 21 by a split ring 28. The sleeve 11 has an annulus of preferably equidistant recesses 25 each of which can receive the tip of the arresting member 23 when the latter is depressed to its operative position by means of a manually operable knob 24.

The parts which are shown in FIG. 2 can be readily taken apart and reassembled. Thus, in order to gain access to the gear 16 and to the nut 10, it is merely necessary to remove the cover 29 of the housing 14 while the coil spring 21 is permitted to maintain the arresting member 23 in the illustrated retracted position so that the end portion 12 of the inner shaft 1' can be extracted from the inner race of its bearing 13.

If a worn or damaged grinding wheel 4 is to be replaced or removed for another reason, the operator depresses the arresting member 23 by way of the knob 24 against the opposition of the coil spring 22 so that the tip of the arresting member enters a recess 25 of the sleeve 11. In the next step, the prime mover 35 of the drive means for the shaft 1" is started for a short interval of time so that the step-down transmission 17 rotates the shaft 1" while the shaft 1' is held against rotation by the arresting unit 20. The clamping portion 2 shares the angular movement of the shaft 1" and thereby rotates by friction the grinding wheel 4 which, in turn, rotates the clamping portion 3 relative to the arrested shaft 1'. Therefore, the clamping portion 3 moves axially and away from the clamping portion 2 and the two clamping portions relax their grip upon the respective sides of the grinding wheel 4 between them. If necessary, the operator thereupon uses a suitable tool whose studs enter the holes 7, 7' of the clamping portion 3 to complete the separation of this clamping portion from the shaft 1' and to thus allow for removal of the grinding wheel 4 from the spindle 1.

The exact manner in which the clamping portion 2 is non-rotatably affixed to the hollow outer shaft 1" forms no part of the invention. For example, the front end face of the shaft 1" can be serrated and its teeth can enter complementary tooth spaces in the adjacent end face of the clamping portion 2. In addition, or in lieu of such serrations, the shaft 1" can be formed with a non-circular front end portion which extends into a complementary hole of the clamping portion 2. Furthermore, screws or other types of fasteners can be used to affix the clamping portion 2 to the shaft 1".

Figure 3:
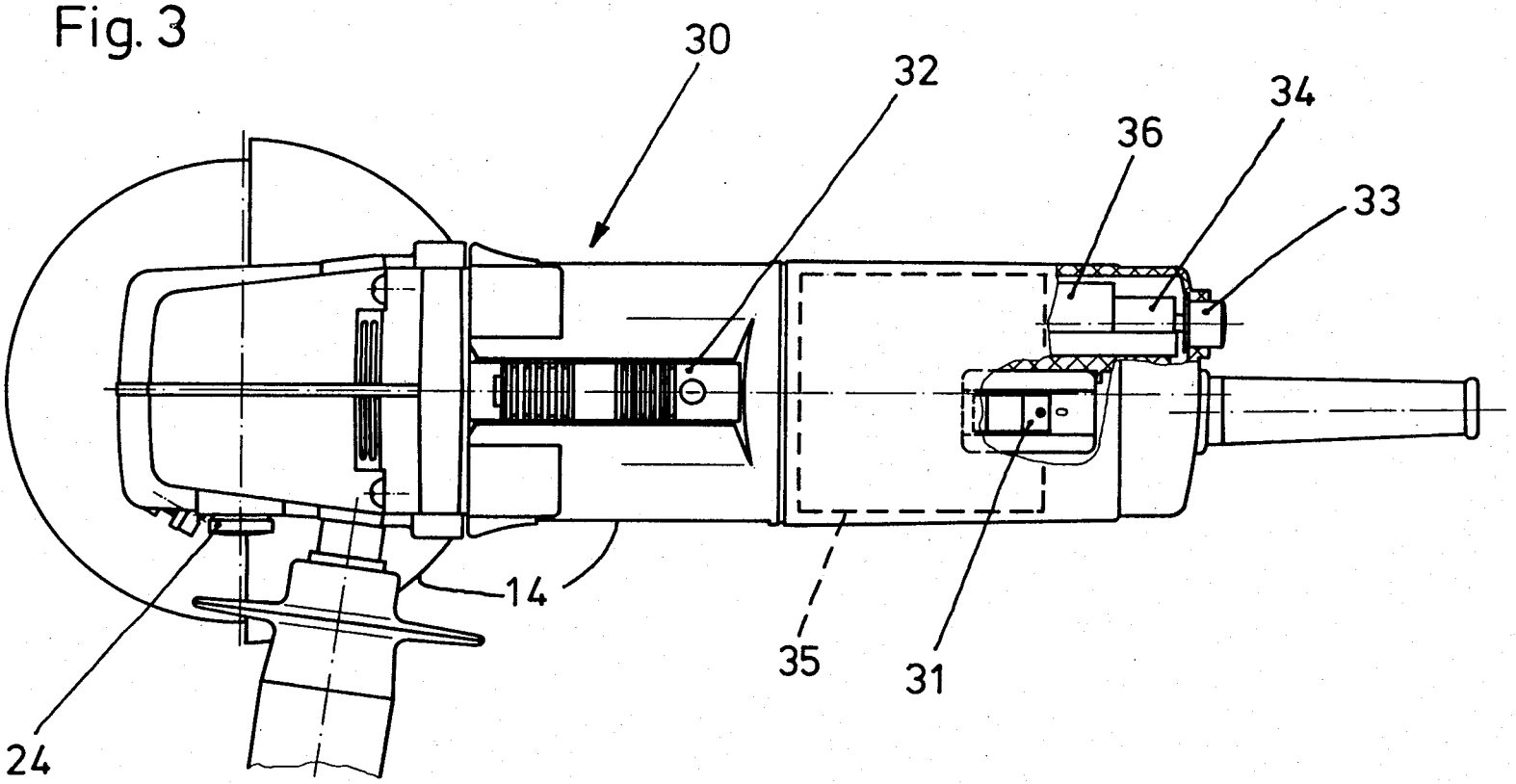
FIG. 3 is a plan view of the power tool which is shown in FIG. 2.

FIG. 3 shows the entire power tool 30 with a master switch 31 which is movable relative to the housing 14 by a reciprocable pusher 32 coupled to the switch 31 by a suitable linkage, not shown.

FIG. 3 further shows the knob 24 which serves to depress the arresting member 23 of FIG. 2 against the opposition of the coil spring 22. The housing 14 further contains a second switch 34 which can be closed by an actuator 33 for the purpose of completing the circuit of the prime mover 35 in the housing 14 for a relatively short interval of time so as to loosen the grip of clamping portions 2, 3 upon the grinding wheel 4 and to move the clamping portion 3 axially of the shaft 1' while the latter is held against rotation by the depressed arresting member 23. The switch 34 can be a commercially available single-pole switch of the type manufactured and sold by the West German firm Marquardt under the designation 1005.0404. An electronic component 36 in the circuit of the prime mover 35 ensures that the prime mover is started for a short interval of time regardless of the duration of depression of the actuator 33. Thus, when the actuator 33 is depressed to close the switch 34, the prime mover 35 receives a short-lasting current impulse which suffices to ensure reliable loosening of the grinding wheel 4 in order to facilitate complete separation of the clamping portion 3 from the shaft 1'. The component 36 further ensures that the amount of energy which the prime mover 35 receives in response to closing of the switch 33 does not suffice to generate a pronounced moment of reaction which would have to be taken up by the manipulator of the power tool. The component 35 is a commercially available module or group of modules including capacitors, resistors, transistors and other parts. Such components are available on the market and are manufactured, for example, by the West German firms Intermetall and Röderstein.

The step-down transmission 17 ensures that the shaft 1" is rotated at a speed which is a small fraction of the RPM of the normally rapidly rotating output element of the prime mover 35. The component 36 can be used with particular advantage in a powerful portable grinding or like tool whose output is rather high. This reduces the likelihood of injury to the operator during starting of the prime mover 35.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A portable power tool, particularly an electric grinder or sander, comprising a rotary tool supporting spindle including a hollow shaft and an inner shaft in said hollow shaft; drive means for one of said shafts; tool clamping means including first and second clamping portions respectively mounted on said inner and hollow shafts and being movable apart, to thereby release a tool which is clamped therebetween, in response to rotation of said shafts relative to each other; and means for arresting the other of said shafts so as to effect a movement of said clamping portions apart and to thus effect a release of the tool between such clamping portions by rotating the one shaft while the other shaft is held against rotation, said arresting means comprising an arresting member which is movable by hand to a position of engagment with said other shaft and means for yieldably biasing said arresting member away from said position, said other shaft including a main portion and an annular portion separably affixed to said main portion and having a plurality of recesses which are angularly offset realtive to each other in the circumferential direction of said other shaft, said arresting member having a portion which is received in one of said recesses in the position of engagement of said arresting member with said other shaft.

2. The power tool of claim 1, wherein the main portion of said other shaft has an externally splined section and said annular portion nonrotatably surrounds said splined section.

3. The power tool of claim 2, further comprising a nut mating with said other shaft and arranged to hold said annular portion on said splined section.

4. The power tool of claim 3, wherein said shafts have portions remote from said clamping portions and further comprising a housing, first antifriction bearing means installed in said housing and surrounding said poriton of said inner shaft, and second antifriction bearing means installed in said housing and surrounding said portion of said hollow shaft, said first and second bearing means being spaced apart from one another in the axial direction of said shafts and said drive means comprising a gear rigid with said hollow shaft between said first and second bearing means, said inner shaft further having a second portion adjacent said first bearing means and mating with said nut, said splined section forming part of said inner shaft and being adjacent said second portion.

5. The power tool of claim 1, wherein said drive means comprises an electric motor and further comprising operating means actuatable to start said motor for a selected interval of time for the purpose of rotating said one shaft realtive to said other shaft so as to release the tool between said clamping portions.

6. A portable power tool, particularly an electric grinder or sander, comprising a rotary tool supporting spindle including a hollow shaft and an inner shaft in said hollow shaft; drive means for one of said shafts, said drive means comprising an electric motor; tool clamping means including first and second clamping poritons respectively mounted on said inner and hollow shafts and being movable apart, to therby release a tool which is clamped therebetween, in response to rotation of said shafts relative to each other; means for arresting the other of said shafts so as to effect a movement of said clamping portions apart and to thus effect a release of the tool between such clamping portions by rotating the one shaft while the other shaft is held against rotation; and operating means actuatable to start said motor for a selected interval of time for the purpose of rotating said one shaft relative to said other shaft so as to release the tool between said clamping portions.

7. The power tool of claim 6, wherein said arresting means comprises an arresting member which is movable by hand to a position of engagement with said other shaft, and means for yieldably biasing said arresting member away from said position.

8. The power tool of claim 7, wherein said other shaft has at least one recess and said arresting member has a portion which is received in said recess in the position of engement of said arresting member with said other shaft.

9. The power tool of claim 8, wherein said shafts have limited freedom of axial movement relative to each other.

10. The power tool of claim 8, wherein one portion of said clamping means is rigid or integral with said hollow shaft and the other portion of said clamping means has internal threads mating with external threads provided therefor on said inner shaft.

11. The power tool of claim 8, further comprising a housing for said shafts, said housing having a substantially tubular socket and said arresting means constituting a module which is removably installed in said socket, said arresting member having an abutment and said biasing means comprising a spring which reacts against said socket and bears against said abutment to oppose the movement of said arresting member substantially radially of and toward said other shaft.

12. The power tool of claim 11, wherein said socket comprises means for limiting the extent of movability of said arresting member under the action of said spring.

13. The power tool of claim 6, wherein said operating means comprises an electric switch which is operable to transmit to the motor a short-lasting current impulse irrespective of the duration of actuation of said switch.

14. The power tool of claim 6, further comprising means for limiting the amount of electrical energy which is supplied to said motor in response to actuation of said operating means.

* * * * *